US012492859B2

(12) United States Patent
Padilla Flores et al.

(10) Patent No.: US 12,492,859 B2
(45) Date of Patent: Dec. 9, 2025

(54) REFRIGERATOR APPLIANCE SUBCOMPONENT MOUNTING SYSTEM

(71) Applicant: WHIRLPOOL CORPORATION, Benton Harbor, MI (US)

(72) Inventors: Jesus Padilla Flores, Ramos Arizpe (MX); Antonio Sanchez, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 405 days.

(21) Appl. No.: 17/736,283

(22) Filed: May 4, 2022

(65) Prior Publication Data

US 2023/0358464 A1 Nov. 9, 2023

(51) Int. Cl.
*F25D 23/06* (2006.01)
*F25D 23/02* (2006.01)

(52) U.S. Cl.
CPC ..... *F25D 23/066* (2013.01); *F25D 23/028* (2013.01); *F25D 23/062* (2013.01); *F25D 2317/067* (2013.01)

(58) Field of Classification Search
CPC .... F25D 23/066; F25D 23/028; F25D 23/062; F25D 2317/067
See application file for complete search history.

(56) References Cited

U.S. PATENT DOCUMENTS 3,999,820 A * 12/1976 Haag ..... F25D 23/062 62/DIG. 13
4,107,833 A * 8/1978 Knight ..... F25D 23/064 264/46.7
4,829,653 A * 5/1989 Stich ..... F25D 23/04 29/525.07
5,361,599 A * 11/1994 Dasher ..... F25D 23/067 62/298
5,486,045 A * 1/1996 Dasher ..... A47B 57/06 248/300
5,553,936 A * 9/1996 Dasher ..... A47B 57/06 248/243
5,599,081 A * 2/1997 Revlett ..... F25D 23/02 312/405.1
6,193,455 B1 2/2001 Levey
8,197,019 B2 * 6/2012 Kim ..... F25D 23/067 312/401
8,820,865 B2 * 9/2014 Simpson ..... F25D 23/067 312/410

(Continued)

FOREIGN PATENT DOCUMENTS

CN 102374737 A * 3/2012
CN 105783391 A * 7/2016

(Continued)

*Primary Examiner* — Hanh V Tran
(74) *Attorney, Agent, or Firm* — Brooks Kushman P.C.

(57) ABSTRACT

A refrigerator appliance includes a cabinet, a subcomponent, an anchor, and a fastener. The cabinet has a plurality of walls defining an internal storage chamber. The subcomponent is disposed within the internal storage chamber. The anchor is disposed on an opposing side of a first of the walls relative to the subcomponent. The anchor defines a plurality of orifices. The fastener engages the subcomponent, extends through the first of the walls, and engages one of the plurality of orifices to secure the subcomponent to the first of the walls.

20 Claims, 6 Drawing Sheets

(56) References Cited

U.S. PATENT DOCUMENTS

| | | | | |
|---|---|---|---|---|
| 9,816,747 | B2 * | 11/2017 | An | F25D 23/066 |
| 2007/0228236 | A1 * | 10/2007 | MacKay | A47B 57/06 248/205.3 |
| 2014/0132142 | A1 * | 5/2014 | Kim | F25D 23/025 312/405 |
| 2021/0215415 | A1 | 7/2021 | Potter et al. | |

FOREIGN PATENT DOCUMENTS

| | | | | | |
|---|---|---|---|---|---|
| CN | 106595210 | A | * | 4/2017 | |
| CN | 110173949 | A | * | 8/2019 | |
| CN | 110440513 | A | * | 11/2019 | |
| CN | 113074508 | A | * | 7/2021 | |
| WO | WO-2011080654 | A2 | * | 7/2011 | F25D 23/066 |
| WO | WO-2020207750 | A1 | * | 10/2020 | E05F 15/611 |

* cited by examiner

REFRIGERATOR APPLIANCE SUBCOMPONENT MOUNTING SYSTEM

TECHNICAL FIELD

The present disclosure relates to an appliance such as a refrigerator.

BACKGROUND

In order to keep food fresh, a low temperature must be maintained within a refrigerator to reduce the reproduction rate of harmful bacteria. Refrigerators circulate refrigerant and change the refrigerant from a liquid state to a gas state by an evaporation process in order cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

SUMMARY

A refrigerator appliance includes a cabinet, an inner liner, a subcomponent, a fastening anchor, a fastener, and an insulating material. The cabinet has walls defining an internal cavity. The inner liner is disposed within the internal cavity such that a gap is defined between the walls and the inner liner. The subcomponent is disposed within the internal cavity and secured to the inner liner. The fastening anchor is disposed within the gap on an opposing side of the inner liner relative to the subcomponent. The fastening anchor defines a plurality of orifices. The fastener engages the subcomponent, extends through the liner, and engages the fastening anchor within one of the plurality of orifices to secure the subcomponent to the inner liner and to the fastening anchor. The insulating material is disposed within the gap, between the walls and the inner liner, and over the fastening anchor.

A refrigerator appliance includes a cabinet, a subcomponent, an anchor, and a fastener. The cabinet has a plurality of walls defining an internal storage chamber. The subcomponent is disposed within the internal storage chamber. The anchor is disposed on an opposing side of a first of the walls relative to the subcomponent. The anchor defines a plurality of orifices. The fastener engages the subcomponent, extends through the first of the walls, and engages the anchor within one of the plurality of orifices to secure the subcomponent to the first of the walls.

An appliance includes a plurality of walls, a subcomponent, an anchor block, and a fastener. The subcomponent is secured to a first of the walls. The anchor block is disposed on an opposing side of the first of the walls relative to the subcomponent and defines a plurality of orifices. The fastener engages the subcomponent, extends through the first of the walls, and engages the anchor block within one of the plurality of orifices to secure the subcomponent to the first of the walls and to the anchor block.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
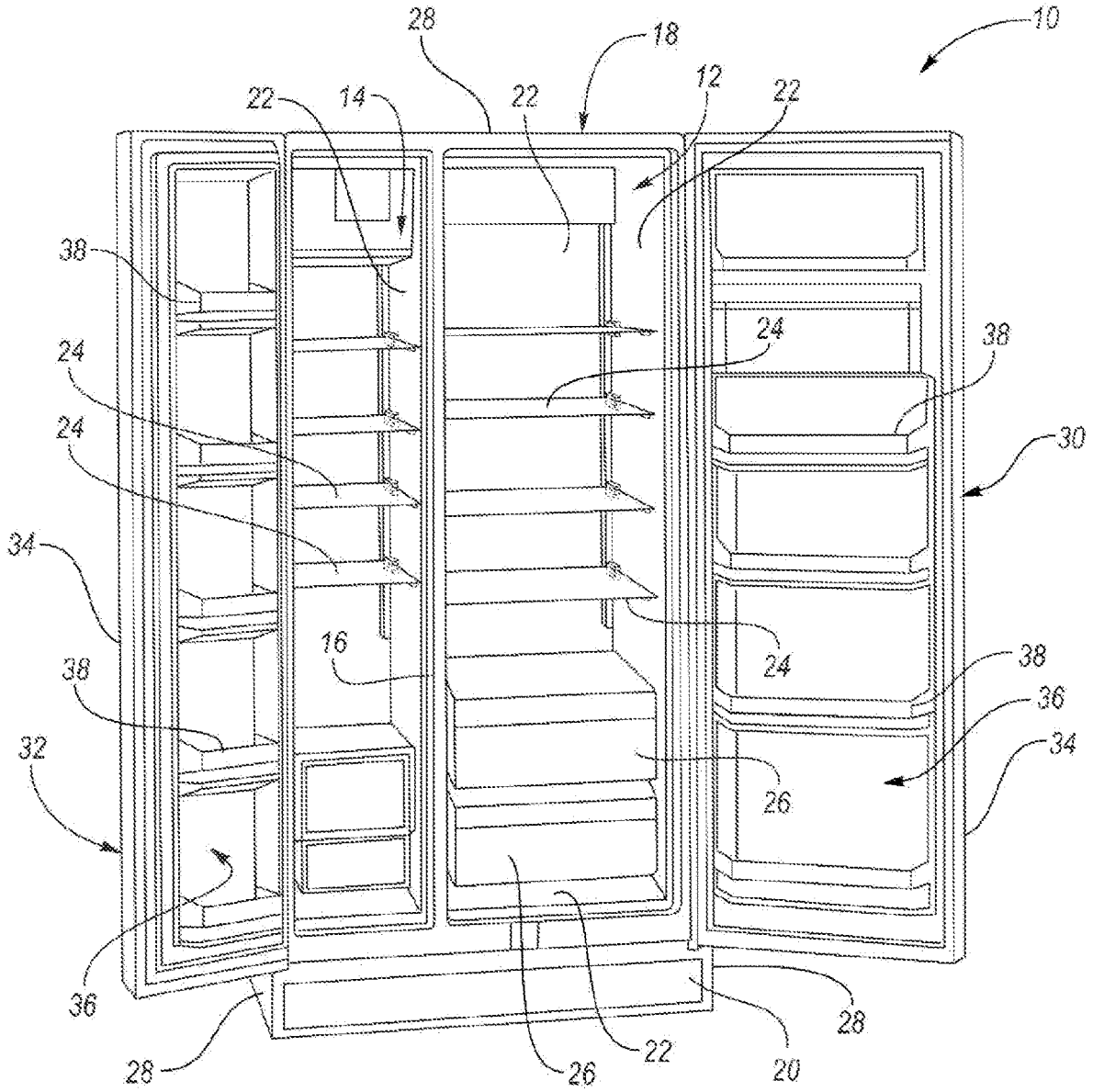
FIG. 1 is a front perspective front view of a side-by-side type refrigerator.

Referring to FIG. 1, generally a refrigerator 10 of the side-by-side type is illustrated. However, it should be understood that this disclosure could apply to any type of refrigerator, such as a side-by-side, French-Door Bottom Mount, or a top-mount type. As shown in FIG. 1, the refrigerator 10 may have a first internal cavity, first internal storage chamber, or fresh food compartment 12 configured to refrigerate and not freeze consumables within the fresh food compartment 12, and a second internal cavity, second internal storage chamber, or a freezer compartment 14 configured to freeze consumables within the freezer compartment 14 during normal use. The refrigeration compartment 12 and the freezer compartment 14 are separated by a dividing wall 16. The fresh food compartment 12 and freezer compartment 14 may be defined by a housing or cabinet 18 of the refrigerator 10. It is generally known that the freezer compartment 14 is typically kept at a temperature below the freezing point of water, and the fresh food compartment 12 is typically kept at a temperature above the freezing point of water and generally below a temperature of from about 35° F. to about 50° F., more typically below about 38° F.

The interior of refrigerator 10, including the refrigeration compartment 12 and the freezer compartment 14, is cooled by one or more evaporators (not shown) that are part of one or more refrigerant loops or circuits. The evaporator may be located in the freezer compartment if only one evaporator is included. Each refrigerant circuit may also include a compressor (not shown) and a condenser (not shown), which may be located in a machine or machinery compartment 20. The condenser is configured to reject heat from the refrigerant circuit to the ambient surroundings. Fans may be utilized to direct air across the evaporator and the condenser to facilitate exchanging heat. The compressor and the fans may be connected to a controller. Sensors that measure the air temperature, humidity, etc. within the refrigeration compartment 12 and the freezer compartment 14 may be in communication with the controller. The controller may be configured to operate the compressor, fans, etc. in response to the air temperature within the refrigeration compartment 12 and the freezer compartment 14 being less than a threshold.

Such a controller may be part of a larger control system and may be controlled by various other controllers throughout the refrigerator 10, and one or more other controllers can collectively be referred to as a "controller" that controls various functions of the refrigerator 10 in response to inputs or signals to control functions of the refrigerator 10. The controller may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the refrigerator 10.

Control logic or functions performed by the controller may be represented by flow charts or similar diagrams in one or more figures. These figures provide representative control strategies and/or logic that may be implemented using one or more processing strategies such as event-driven, interrupt-driven, multi-tasking, multi-threading, and the like. As such, various steps or functions illustrated may be performed in the sequence illustrated, in parallel, or in some cases omitted. Although not always explicitly illustrated, one of ordinary skill in the art will recognize that one or more of the illustrated steps or functions may be repeatedly performed depending upon the particular processing strategy being used. Similarly, the order of processing is not necessarily required to achieve the features and advantages described herein, but is provided for ease of illustration and description.

The control logic may be implemented primarily in software executed by a microprocessor-based controller, such as controller. Of course, the control logic may be implemented in software, hardware, or a combination of software and hardware in one or more controllers depending upon the particular application. When implemented in software, the control logic may be provided in one or more computer-readable storage devices or media having stored data representing code or instructions executed by a computer to control the refrigerator 10 or its subsystems. The computer-readable storage devices or media may include one or more of a number of known physical devices which utilize electric, magnetic, and/or optical storage to keep executable instructions and associated calibration information, operating variables, and the like.

The refrigerator 10, or more specifically the cabinet 18, includes panels or internal walls 22 that define the fresh food compartment 12 and the freezer compartment 14. The internal walls 22 may more specifically form an inner liner of the refrigerator 10. The internal walls 22 may include a rear or back wall, a top wall, a bottom wall, and two opposing side walls within each of the fresh food compartment 12 and the freezer compartment 14. The dividing wall 16 may comprise one of the two opposing side walls in each of the fresh food compartment 12 and the freezer compartment 14. One or more shelves 24 may be secured to the interior walls 22 within the fresh food compartment 12 and/or the freezer compartment 14. One or more drawers 26 may be slidably secured to the shelves 24 or the internal walls 22 within the fresh food compartment 12 and/or the freezer compartment 14. The one or more drawers 26 may be crisper drawers that are slidably secured to the shelves 24 or the internal walls 22 within the fresh food compartment 12 and/or the freezer compartment 14. Crisper drawers may more specifically be drawers that define a storage space that is kept at a desired humidity that may be different from the remainder of the fresh food compartment 12, but that is optimal for maintaining freshness of fruits and vegetables.

The refrigerator 10, or more specifically the cabinet 18, includes an outer shell, frame, or housing that comprises several exterior panels or walls 28. The outer shell, frame, or housing that comprises several exterior panels or walls 28 may also be referred to as the refrigerator cabinet wrapper. The exterior walls 28 may include a rear or back wall, a top wall, a bottom wall, and two side walls. An insulating material, such as an insulating foam, may be disposed between each exterior wall 28 and an adjacent corresponding interior wall 22 in order reduce the heat transfer from the ambient surroundings to the fresh food compartment 12 and the freezer compartment 14, which increases the efficiency of the refrigerator 10. Each exterior wall 28, adjacent corresponding interior wall 22, and the insulating material disposed between each exterior wall 28 and adjacent corresponding interior wall 22 may collectively be referred to as a single wall of the cabinet 18 of the refrigerator 10.

The refrigerator 10 may have one or more doors 30, 32 that provide selective access to the interior volume of the refrigerator 10 where consumables may be stored. As shown, the fresh food compartment door is designated 30, and the freezer door is designated 32. The doors 30, 32 may be rotatably secured to the frame or housing of the refrigerator 10 by one or more hinges. Alternatively, one or more of the doors 30, 32 may be configured to slide into and out of the cabinet 18.

The doors 30, 32 may each include an exterior panel 34 and an interior panel 36 that is disposed on an internal side of the respective exterior panel 34 of each door 30, 32. The interior panels 36 may be configured to face the fresh food compartment 12 and freezer compartment 14 when the doors 30, 32 are in closed positions. The interior panels 36 may more specifically be door liners. An insulating material, such as an insulating foam, may be disposed between the exterior panels 34 and an adjacent corresponding interior panel 36 of each door interior panel 36 in order reduce the heat transfer from the ambient surroundings and increase the efficiency of the refrigerator 10.

The interior panels 36 may also include shelves or storage bins 38 that are able to hold food items or containers. The storage bins 38 may be secured to the interior panels 36 of each door 30, 32. Alternatively, the storage bins 38 may be integrally formed within or defined by the interior panels 36 of each door 30, 32. In yet another alternative, a portion of the storage bins 38 may be secured to the interior panels 36 the doors 30, 32, while another portion of the storage bins 38 may be integrally formed within or defined by the interior panels 36 the doors 30, 32. The storage bins 38 may include shelves (e.g., a lower surface upon, which a food item or container may rest upon) that extend from back and/or side surfaces of the interior panels 36 of the doors 30, 32.

Figure 2:
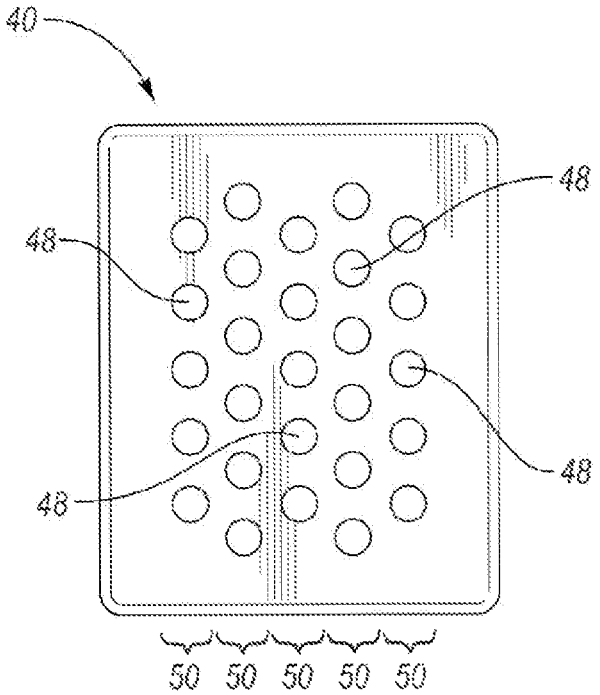
FIG. 2 is a front view of a fastening anchor that is utilized in a system for mounting subcomponents of the refrigerator to a frame or cabinet structure of the refrigerator.
Figure 3:
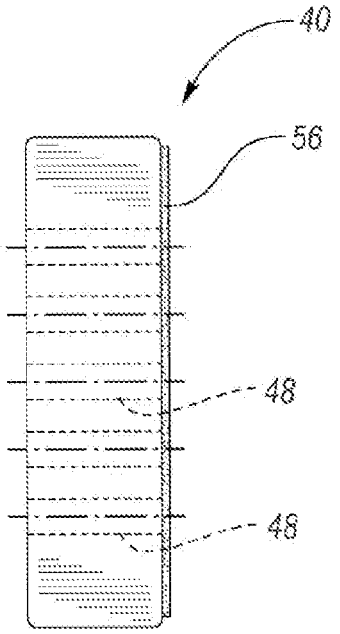
FIG. 3 is a side view of the fastening anchor.
Figure 4:
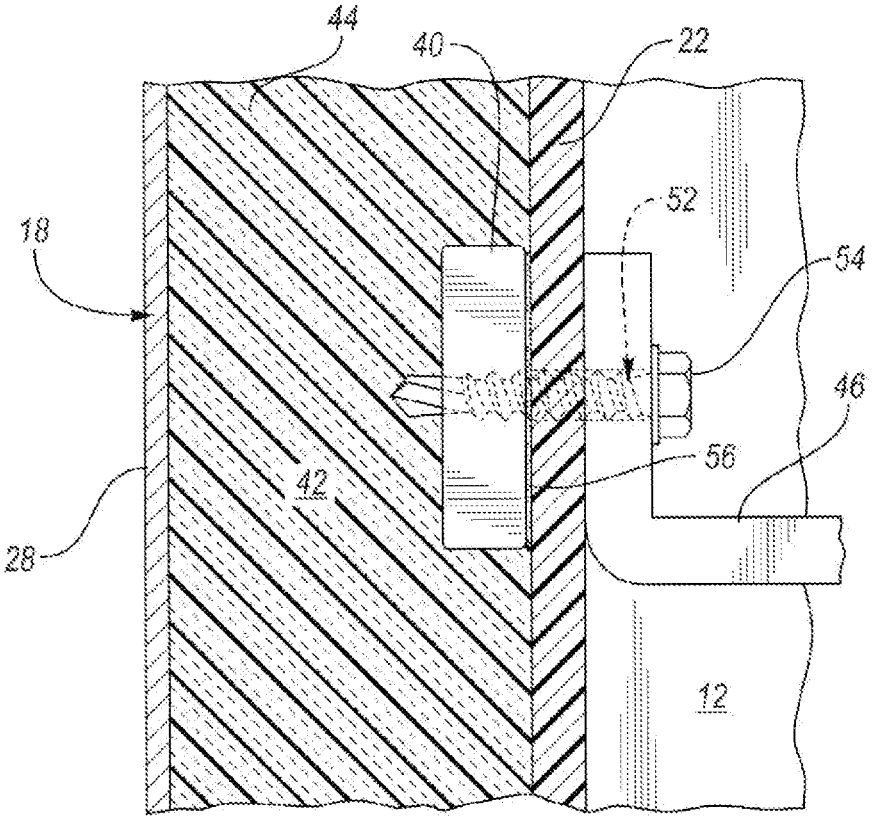
FIG. 4 is a cross-sectional view through one of the side walls of the cabinet illustrating a mounting system for the subcomponents of the refrigerator that includes the fastening anchor and a fastener.
Figure 5A:
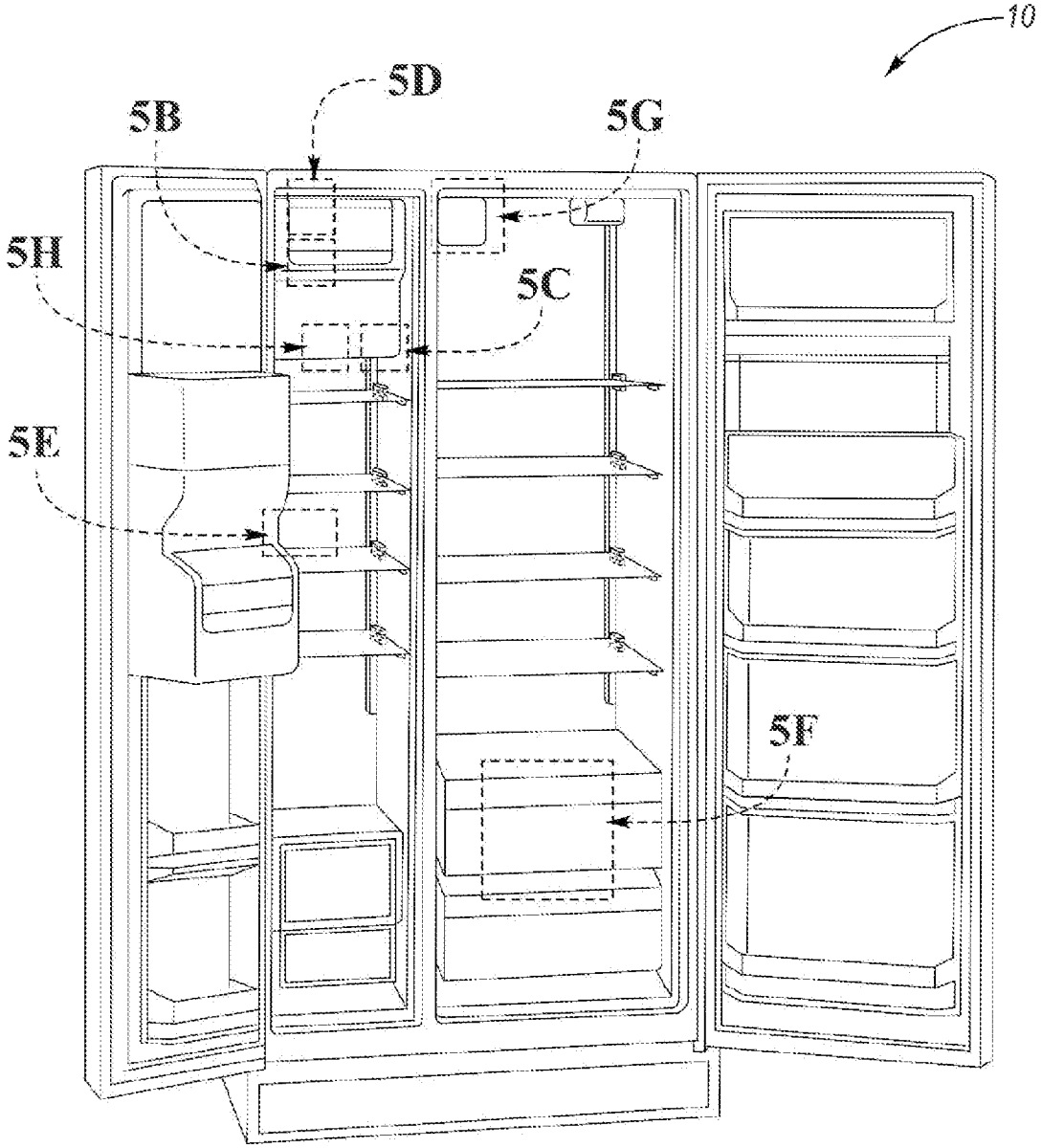
FIGS. 5A-H illustrate several subcomponents of the refrigerator that are mounted to the frame or cabinet structure of the refrigerator via the mounting system.
Figure 5B:
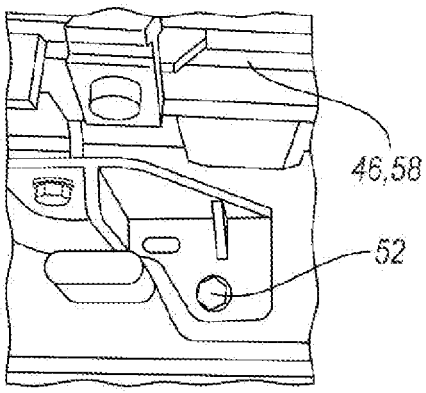
Figure 5C:
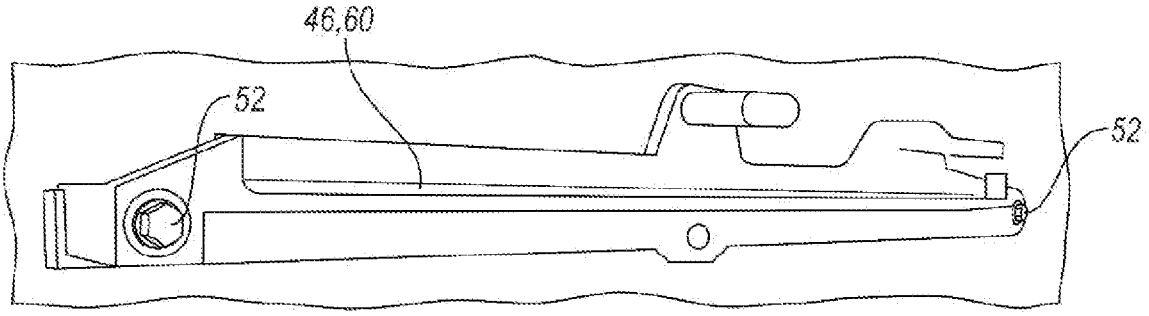
Figure 5D:
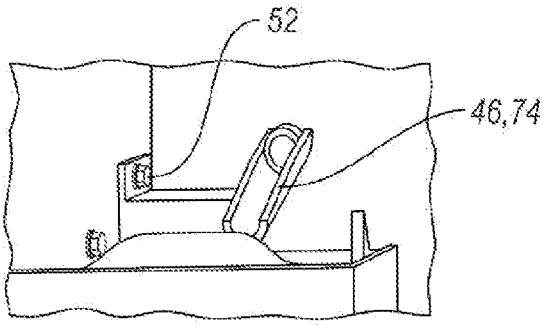
Figure 5E:
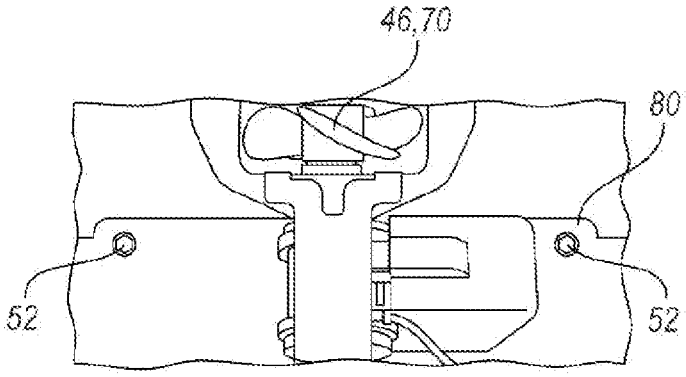
Figure 5F:
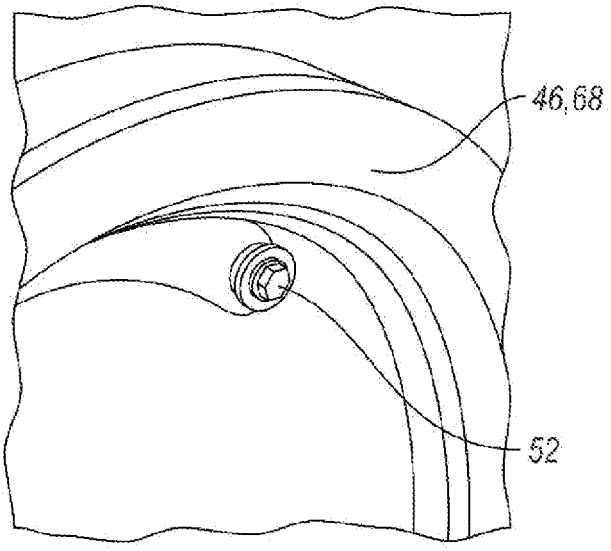
Figure 5G:
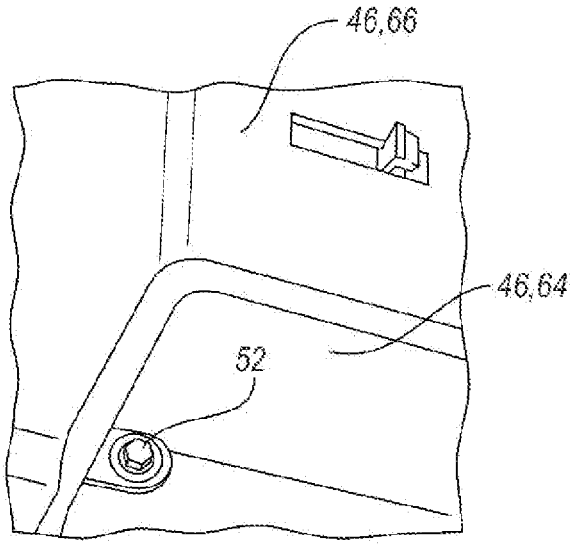
Figure 5H:
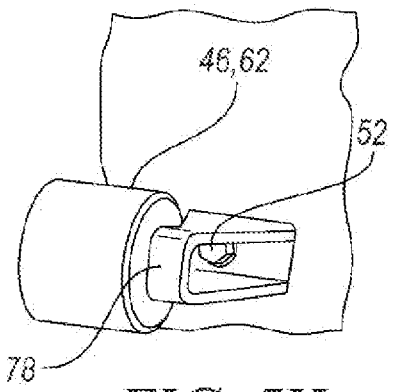
Figure 6A:
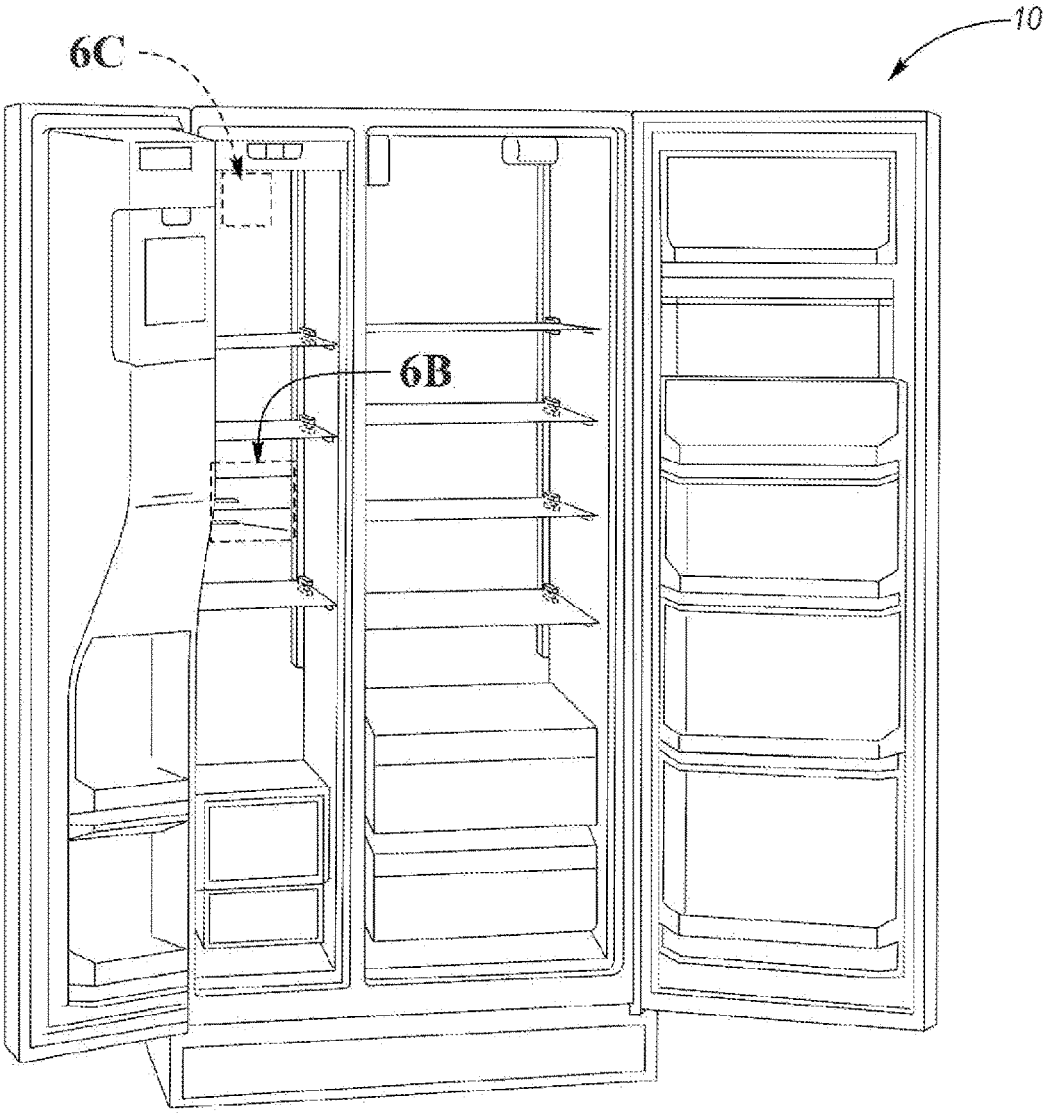
FIGS. 6A-C illustrates additional subcomponents of the refrigerator that are mounted to the frame or cabinet structure of the refrigerator via the mounting system.
Figure 6B:
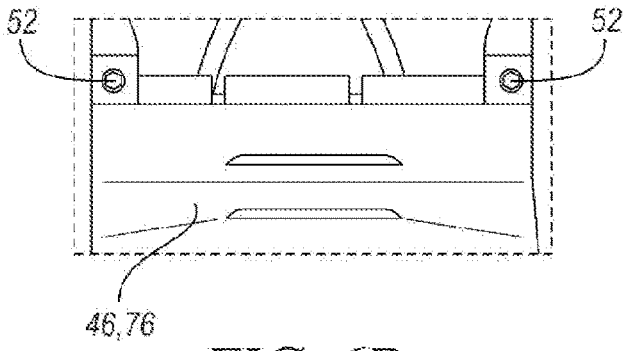
Figure 6C:
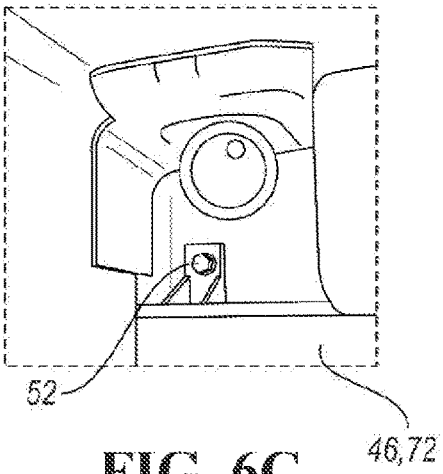

Referring to FIGS. 2-4, a fastening anchor 40 is illustrated in FIGS. 2-3 while a mounting system for the subcomponents of refrigerator 10, which include the fastening anchor 40, is illustrated in FIG. 4. The fastening anchor 40 may be referred to as an anchor or an anchor block. The mounting system may be utilized in appliances other than a refrigerator. FIG. 4 includes a cross-sectional view through one of the walls of the cabinet 18 of the refrigerator 10. The wall illustrated in FIG. 4 may be any of the walls of the cabinet 18 illustrated in FIG. 1. The wall may include one of the exterior walls 28 that is part of the outer shell of the cabinet 18 and a corresponding interior wall 22 that is part of an inner liner of the refrigerator 10. Alternatively, the wall illustrated in FIG. 4 may be an internal wall within the refrigerator 10 (e.g., the wall may be dividing wall 16 or some other internal wall that is within the fresh food compartment 12 or freezer compartment 14).

A gap 42 may be formed between the exterior walls 28 and the interior walls 22. An insulating material 44, such as an insulating foam, may be disposed in the gap 42 between each exterior wall 28 and adjacent corresponding interior wall 22 in order reduce the heat transfer from the ambient surroundings to the fresh food compartment 12 and the freezer compartment 14. A subcomponent 46 of the refrigerator 10 is disposed within the fresh food compartment 12. Alternatively, the subcomponent 46 may be disposed within the freezer compartment 14, other internal cavity defined at some position within cabinet 18, or on the exterior of the cabinet 18.

The subcomponent 46 may be secured to one of the walls of the cabinet 18. More specifically, the subcomponent 46 may be secured to one of the interior walls 22 that is part of an inner liner of the refrigerator 10 and within a desired internal cavity (e.g., the fresh food compartment 12 or the freezer compartment 14). Alternatively, the subcomponent 46 may be secured to the one of the exterior walls 28 that is part of the outer shell of the cabinet 18 if the subcomponent 46 is disposed on the exterior of the cabinet 18.

The fastening anchor 40 may be disposed within the gap 42 on an opposing side of the interior wall 22 relative to the subcomponent 46. Alternatively, the fastening anchor 40 may be disposed within the gap 42 on an opposing side of the exterior wall 28 relative to the subcomponent 46, if the subcomponent 46 is disposed on the exterior of the cabinet 18. The insulating material 44 may be disposed over the fastening anchor 40 and cover the fastening anchor 40 within the gap 42. The fastening anchor 40 may be a block. The exterior surfaces of the fastening anchor 40 may be rectangular in shape. The fastening anchor 40 defines a plurality of orifices 48. The plurality of orifices may define columns or rows 50, depending on the orientation of the fastening anchor 40. The orifices 48 of adjacent columns or rows 50 may be offset relative to each other.

A fastener 52 may engage the subcomponent 46, extending through the interior wall 22, and engage the fastening anchor 40 within one of the plurality of orifices 48 to secure the subcomponent 46 to the interior wall 22 and to the fastening anchor 40, if the subcomponent 46 is disposed within one of the internal cavities (e.g., the fresh food compartment 12 or the freezer compartment 14). More specifically, the subcomponent 46 may define a first through-hole, the interior wall 22 may define a second through-hole, and the fastener 52 may extend through the first through-hole, through the second through-hole, and engage the fastening anchor 40 within one of the plurality of orifices 48. The orifices 48 may be tapped holes and the fastener 52 may engage the fastening anchor 40 within one of the tapped holes. Alternatively, the orifices 48 may be through-holes and the fastener 52 may be a self-tapping fastener that engages the fastening anchor 40 within a first of the orifices 48 and taps the first of the orifices 48 to secure the fastener 52 to the fastening anchor 40. The fastener 52 may have a head 54 that is larger than the diameter of the first through-hole defined by the subcomponent 46 so that the fastener 52 may operate to retain the position of the subcomponent 46 within one of the internal cavities (e.g., the fresh food compartment 12 or the freezer compartment 14).

Alternatively, the fastener 52 may engage the subcomponent 46, extending through the exterior wall 28, and engage the fastening anchor 40 within one of the plurality of orifices 48 to secure the subcomponent 46 to the exterior wall 28 and to the fastening anchor 40, if the subcomponent 46 is disposed on the exterior of the cabinet 18. More specifically, the subcomponent 46 may define a first through-hole, the exterior wall 28 may define a second through-hole, and the fastener 52 may extend through the first through-hole, through the second through-hole, and engage the fastening anchor 40 within one of the plurality of orifices 48. The plurality of orifices may be pre-tapped holes or may be tapped by the fastener 52, if the fastener 52 is self-tapping.

A fastening anchor that includes a single orifice that is configured to receive a fastener for mounting a subcomponent to a wall of a refrigerator or other appliance requires precise alignment of the single orifice with a desired position of the subcomponent. More specifically, precise alignment is required between the single orifice defined by the fastening anchor and a through-hole defined by the wall (e.g., interior wall 22 or exterior wall 28) that corresponds to a desired mounting position for the subcomponent. This may present a challenge, particularly if the fastening anchor is pre-positioned prior to mounting the subcomponent, if the fastening anchor has been overlayed with an insulating material, and/or if the fastening anchor is positioned in a place (e.g., gap 42) that will require disassembly in order to realign the fastening anchor. The fastening anchor 40 disclosed herein alleviates such a challenge by providing several orifices 48 such that at least one of the orifices 48 is within a tolerable range of any desired alignment when the fastening anchor 40 is pre-positioned prior to mounting the subcomponent 46.

The fastener 52 may be made from a first material and the fastening anchor 40 may be made from a second material. The first material may be harder than the second material to facilitate tapping the orifices 48, particularly if the fastener 52 is a self-tapping fastener. For example, the fastener 52 may be made from a metallic material, such as steel, aluminum, brass, or other appropriate metallic material, while the fastening anchor 40 may be made from a plastic material, such as an epoxy, vinylester, polyester thermosetting plastic, phenol formaldehyde resin, nylon, or other appropriate polymer or plastic.

The fastening anchor 40 may include an adhesive back 56. The adhesive back 56 may include a pull-away portion that protects the adhesive back 56 prior to positing the fastening anchor 40 in a desired position. The adhesive back 56 may engage the interior wall 22 to secure the fastening anchor 40 to the interior wall 22 and within the gap 42, if the subcomponent 46 is disposed within one of the internal cavities (e.g., the fresh food compartment 12 or the freezer compartment 14). The fastening anchor 40 should also be positioned over and aligned with a through-hole defined by the interior wall 22 which corresponds to a desired mounting position for the subcomponent 46 and provides a pathway for the fastener 52 to engage the fastening anchor 40.

Alternatively, the adhesive back 56 may engage the exterior wall 28 to secure the fastening anchor 40 to the exterior wall 28 and within the gap 42, if the subcomponent 46 is disposed on the exterior of the cabinet 18. The fastening anchor 40 should also be positioned over and aligned with a through-hole defined by the exterior wall 28 which corresponds to a desired mounting position for the subcomponent 46 and provides a pathway for the fastener 52 to engage the fastening anchor 40.

Referring to FIGS. 5A-6C, several subcomponents 46 of the refrigerator 10 that are mounted to the frame or cabinet structure 18 of the refrigerator 10 via the mounting system are illustrated. Each subcomponent 46 may be mounted to the frame or cabinet structure 18 of the refrigerator 10 via one or more of the mounting systems. More specifically, each subcomponent 46 may be mounted to the frame or cabinet structure 18 of the refrigerator 10 via one or more fasteners 52, where each fastener 52 engages a separate fastening anchor 40 that is disposed on an opposing side of a wall relative to the subcomponent 46 and the fastener 52.

The subcomponents 46 may disposed within one of the internal cavities (e.g., the fresh food compartment 12 or the freezer compartment 14) of the refrigerator 10 or along the exterior of the refrigerator 10. Each subcomponent 46 may be secured to a wall of the refrigerator as illustrated in FIG. 4. The subcomponent 46 may be an ice maker 58, an ice container track 60, a motor 62 (e.g., for a refrigerant compressor, fan, or ice maker mechanism), an air diffuser 64, an air diffuser cover 66, a water tank 68, a fan 70 (e.g., a fan that directs air across an evaporator or condenser and corresponding mounting hardware or bracketry), an air duct 72, an ice maker water delivery chute 74, an evaporator cover 76, a bracket that is connected to any of the other subcomponents (e.g., a motor bracket 78 or a fan bracket 80) or any other subcomponent 46 that is mounted to the cabinet 18 or frame of the refrigerator 10.

It should be understood that the designations of first, second, third, fourth, etc. for any component, state, or condition described herein may be rearranged in the claims so that they are in chronological order with respect to the claims. Furthermore, it should be understood that any component, state, or condition described herein that does not have a numerical designation may be given a designation of first, second, third, fourth, etc. in the claims if one or more of the specific component, state, or condition are claimed.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A refrigerator appliance comprising:

a cabinet having walls defining an internal cavity;

an inner liner disposed within the internal cavity such that a gap is defined between the walls and the inner liner;

a subcomponent disposed within the internal cavity and secured to the inner liner;

a fastening anchor disposed within the gap on an opposing side of the inner liner relative to the subcomponent, the fastening anchor defining a plurality of orifices; orifices, wherein each orifice of the plurality of orifices is configured to engage fastener threads;

a fastener (i) engaging the subcomponent, (ii) extending through the liner, and (iii) engaging the fastening anchor within one of the plurality of orifices to secure the subcomponent to the inner liner and to the fastening anchor; and an insulating material (i) disposed within the gap, (ii) between the walls and the inner liner, and (iii) over the fastening anchor.

2. The refrigerator appliance of claim 1, wherein the fastening anchor is a block.

3. The refrigerator appliance of claim 1, wherein the fastening anchor has an adhesive back securing the fastening anchor to the inner liner.

4. The refrigerator appliance of claim 1, wherein (i) each orifices is sized to engage the fastener; (ii) the fastener is a self-tapping fastener configured to engage the fastening anchor within each orifice of the plurality of orifices and tap each orifice of the plurality of orifices; and (iii) the fastener (a) extends through aligned through holes defined by the liner and subcomponent and (b) engages the fastening anchor within a first orifice of the plurality of orifices to secure the fastener to the fastening anchor, wherein the first office of the plurality of orifices has a relative alignment with the aligned through holes that is within a tolerable range while a remainder of the orifices of the plurality of orifices have relative alignments with the aligned through holes that are outside of the tolerable range.

5. The refrigerator appliance of claim 1, wherein the plurality of orifices forms a plurality of rows.

6. The refrigerator appliance of claim 5, wherein orifices of adjacent rows are offset relative to each other.

7. The refrigerator appliance of claim 1, wherein the subcomponent is an ice maker, an ice container track, a motor, an air diffuser, an air diffuser cover, a water tank, a fan, an air duct, an ice maker water delivery chute, or an evaporator cover.

8. The refrigerator appliance of claim 1, wherein (i) each orifice of the plurality of orifices is tapped; (ii) the fastener is configured to engage the fastening anchor within each orifice of the plurality of orifices; and (iii) the fastener (a) extends through aligned through holes defined by the liner and subcomponent and (b) engages the fastening anchor within a first orifice of the plurality of orifices to secure the fastener to the fastening anchor, wherein the first office of the plurality of orifices has a relative alignment with the aligned through holes that is within a tolerable range while a remainder of the orifices of the plurality of orifices have relative alignments with the aligned through holes that are outside of the tolerable range.

9. A refrigerator appliance comprising:

a cabinet having a plurality of walls defining an internal storage chamber;

a subcomponent disposed within the internal storage chamber;

an anchor disposed on an opposing side of a first of the walls relative to the subcomponent, the anchor defining a plurality of orifices, wherein each orifice of the plurality of orifices is configured to engage fastener threads; and a fastener (i) engaging the subcomponent, (ii) extending through the first of the walls, and (iii) engaging the anchor within one of the plurality of orifices to secure the subcomponent to the first of the walls.

10. The refrigerator appliance of claim 9, wherein the anchor has an adhesive back securing the anchor to the first of the walls.

11. The refrigerator appliance of claim 9, wherein (i) each orifices is sized to engage the fastener; (ii) the fastener is a self-tapping fastener configured to engage the anchor within each orifice of the plurality of orifices and tap each orifice of the plurality of orifices; and (iii) the fastener (a) extends through aligned through holes defined by the first of the walls and subcomponent and (b) engages the anchor within a first orifice of the plurality of orifices to secure the fastener to the anchor, wherein the first office of the plurality of orifices has a relative alignment with the aligned through holes that is within a tolerable range while a remainder of the orifices of the plurality of orifices have relative alignments with the aligned through holes that are outside of the tolerable range.

12. The refrigerator appliance of claim 9, wherein the plurality of orifices forms a plurality of rows.

13. The refrigerator appliance of claim 12, wherein orifices of adjacent rows are offset relative to each other.

14. The refrigerator appliance of claim 9, wherein the subcomponent is an ice maker, an ice container track, a motor, an air diffuser, an air diffuser cover, a water tank, a fan, an air duct, an ice maker water delivery chute, or an evaporator cover.

15. The refrigerator appliance of claim 9, wherein (i) each orifice of the plurality of orifices is tapped; (ii) the fastener is configured to engage the anchor within each orifice of the plurality of orifices; and (iii) the fastener (a) extends through aligned through holes defined by the first of the walls and subcomponent and (b) engages the anchor within a first orifice of the plurality of orifices to secure the fastener to the anchor, wherein the first office of the plurality of orifices has a relative alignment with the aligned through holes that is within a tolerable range while a remainder of the orifices of the plurality of orifices have relative alignments with the aligned through holes that are outside of the tolerable range.

16. An appliance comprising:

a plurality of walls;

a subcomponent secured to a first of the walls;

an anchor block (i) disposed on an opposing side of the first of the walls relative to the subcomponent and (ii) defining a plurality of orifices, wherein each orifice of the plurality of orifices is configured to engage fastener threads; and a fastener (i) engaging the subcomponent, (ii) extending through the first of the walls, and (iii) engaging the anchor block within one of the plurality of orifices to secure the subcomponent to the first of the walls and to the anchor block.

17. The appliance of claim 16, wherein the plurality of orifices forms a plurality of rows.

18. The appliance of claim 17, wherein orifices of adjacent rows are offset relative to each other.

19. The appliance of claim 16, wherein (i) each orifice of the plurality of orifices is tapped; (ii) the fastener is configured to engage the anchor block within each orifice of the plurality of orifices; and (iii) the fastener (a) extends through aligned through holes defined by the first of the walls and subcomponent and (b) engages the anchor block within a first orifice of the plurality of orifices to secure the fastener to the anchor block, wherein the first office of the plurality of orifices has a relative alignment with the aligned through holes that is within a tolerable range while a remainder of the orifices of the plurality of orifices have relative alignments with the aligned through holes that are outside of the tolerable range.

20. The appliance of claim 16, wherein (i) each orifice of the plurality of orifices is sized to engage the fastener; (ii) the fastener is a self-tapping fastener configured to engage the anchor block within each orifice of the plurality of orifices and tap each orifice of the plurality of orifices; and (iii) the fastener (a) extends through aligned through holes defined by the first of the walls and subcomponent and (b) engages the anchor block within a first orifice of the plurality of orifices to secure the fastener to the anchor block, wherein the first office of the plurality of orifices has a relative alignment with the aligned through holes that is within a tolerable range while a remainder of the orifices of the plurality of orifices have relative alignments with the aligned through holes that are outside of the tolerable range.

* * * * *